United States Patent [19]

Sutherland

[11] Patent Number: 4,702,217

[45] Date of Patent: Oct. 27, 1987

[54] FUEL VAPORIZATION AND PRESSURIZATION SYSTEM FOR AN INTERNAL COMBUSTION ENGINE

[76] Inventor: Donald J. Sutherland, 1102-102 Agnes Street, Vancouver, British Columbia, Canada, V3L 1E3

[21] Appl. No.: 939,795

[22] Filed: Dec. 9, 1986

[51] Int. Cl.[4] ..... F02M 17/26

[52] U.S. Cl. ..... 123/523; 123/590; 123/575

[58] Field of Search ..... 123/523, 524, 590, 575

[56] References Cited

U.S. PATENT DOCUMENTS

| | | | |
|---|---|---|---|
| 2,991,777 | 7/1961 | Foreman et al. | 123/557 |
| 3,110,296 | 11/1963 | Lundi | 123/557 |
| 3,768,730 | 10/1973 | Campbell | 123/557 |
| 4,191,153 | 3/1980 | Sterm et al. | 123/523 |
| 4,216,751 | 8/1980 | Davison et al. | 123/523 |
| 4,303,051 | 12/1981 | Weishaar | 123/557 |
| 4,326,492 | 4/1982 | Leibrand, Sr. et al. | 123/557 |
| 4,342,303 | 8/1982 | McCord | 123/557 |
| 4,345,570 | 8/1982 | McNeece | 123/557 |
| 4,386,593 | 6/1983 | Tibbs | 123/523 |
| 4,476,841 | 10/1984 | Duckworth | 123/523 |

*Primary Examiner*—E. Rollins Cross

*Attorney, Agent, or Firm*—Trask, Britt & Rossa

[57] ABSTRACT

The fuel economy of an internal combustion engine having a fuel tank from which fuel is supplied to a carburetor for controlled delivery to the engine may be improved by vaporizing and pressurizing the fuel before it reaches the carburetor. A fuel vaporization system includes a vapor tank for containing pressurized, vaporized fuel. The fuel is vaporized with a nozzle through which the fuel is sprayed into the vapor tank under high pressure. A high pressure pump is used to pump fuel from the fuel tank and force the fuel through the nozzle under high pressure. A fuel delivery line is provided for delivering pressurized, vaporized fuel from the vapor tank to the carburetor.

12 Claims, 2 Drawing Figures

FUEL VAPORIZATION AND PRESSURIZATION SYSTEM FOR AN INTERNAL COMBUSTION ENGINE

FIELD OF THE INVENTION

This invention pertains to internal combustion engine fuel systems of the type having a fuel tank from which fuel is supplied to a carburetor for controlled delivery to the engine. In particular, the invention pertains to such systems in which the fuel is pressurized and vapourized before it reaches the carburetor.

BACKGROUND OF THE INVENTION

Conventional internal combustion engines have fuel systems including a fuel tank, fuel filter, fuel pump and carburetor. The fuel pump pumps fuel from the fuel tank through the fuel filter (which removes foreign matter from the fuel) to the carburetor, which controls delivery of the fuel to the engine intake manifold. The inventor has found that the fuel economy of such systems may be improved by pressurizing and vapourizing the fuel before it reaches the carburetor. For example, a 1984 Ford Sierra station wagon having a two liter engine modified in accordance with the invention was driven 169.5 miles, during which the vehicle consumed 3.4 gallons of gasoline, thereby achieving 49.85 miles per gallon. The modifications of the invention were removed and the same vehicle was then driven a further 168 miles over the same terrain covered by the modified vehicle, during which time the vehicle consumed 6.1 gallons of gasoline, thereby achieving only 27.54 miles per gallon. As another example, a 360 cubic inch Dodge Charger engine modified in accordance with the invention achieved 23 miles per gallon in consuming a measured amount of gasoline, while coupled to a dynamometer. The same engine achieved only 13 miles per gallon in consuming the same measured amount of gasoline and operating under the same conditions, after the modifications of the invention were removed.

SUMMARY OF THE INVENTION

The invention provides a fuel pressurization and vapourization system for an internal combustion engine having a fuel tank from which fuel is supplied to a carburetor for controlled delivery to the engine. The system comprises a vapour tank for containing pressurized, vapourized fuel; a nozzle for vapourizing the fuel and for spraying the vapourized fuel under high pressure into the vapour tank; a high pressure pump for pumping fuel from the fuel tank and for forcing the fuel through the nozzle under high pressure; and, a fuel delivery line for delivering pressurized, vapourized fuel from the vapour tank to the carburetor. A pressure relief valve is coupled between the vapour tank and the carburetor to return excess fuel from the vapour tank to the fuel tank if the vapour pressure in the vapour tank exceeds a preselected amount which, in the preferred embodiment, is 12 pounds per square inch ("p.s.i.").

DETAILED DESCRIPTION OF THE PREFERRED EMBODIMENT

Figure 1:
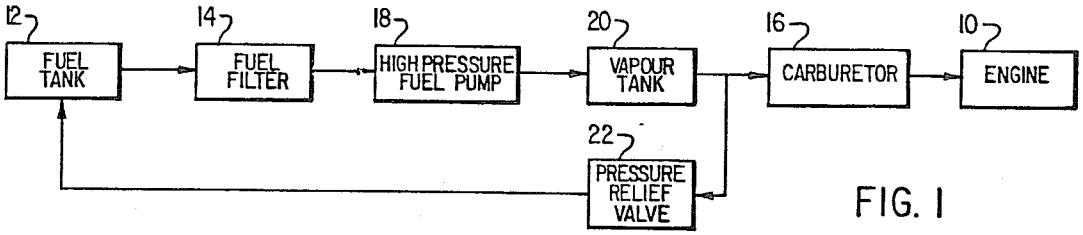
FIG. 1 is a block diagram of a fuel pressurization and vapourization system according to the invention.

FIG. 1 is a block diagram which illustrates a conventional internal combustion engine 10 having a conventional fuel tank 12, a conventional fuel filter 14 and a conventional carburetor 16. In accordance with the invention the conventional fuel pump is replaced with a high pressure fuel pump 18 capable of pressurizing the fuel to about 100 to 125 p.s.i. In the preferred embodiment pump 18 is a 12 volt pump manufactured by Lucas of England under part No. 54073012. A steel vapour tank 20 for containing pressurized, vapourized fuel is connected between fuel pump 18 and carburetor 16 as hereinafter explained in greater detail. A pressure relief valve 22 is coupled between vapour tank 20 and carburetor 16 to return excess pressurized fuel from vapour tank 20 to fuel tank 12 if the vapour pressure in vapour tank 20 should exceed about 12 p.s.i.

Figure 2:
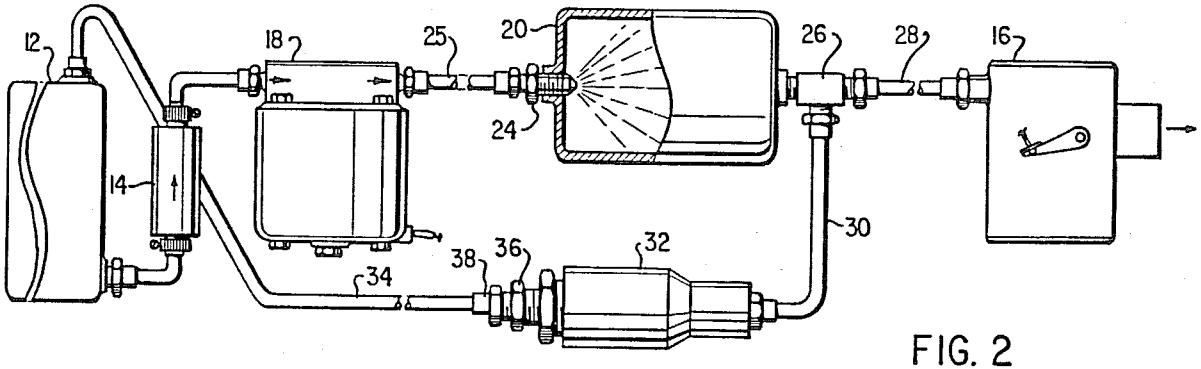
FIG. 2 provides a pictorial representation of the components included in the preferred embodiment.

With reference to FIG. 2, high pressure pump 18 draws fuel from tank 12 through filter 14 and delivers the fuel at a pressure of about 100 to 125 p.s.i. to nozzle 24 which is threadably mounted in the end of vapour tank 20. While pressurized, nozzle 24 preferably sprays about 3 gallons of liquid fuel per hour into tank 20. The size of the jet incorporated in nozzle 24 may vary from about 1.25 (i.e. 0.011 inches—for small engines) to about 4.5 (i.e. 0.021 inches—for larger engines). High pressure pump 18 forces the pressurized fuel through steel fuel line 25, which should be capable of safely withstanding internal pressures of at least 300 p.s.i., and then through nozzle 24 which vapourizes the fuel by spraying it into vapour tank 20 under high pressure. Vapour tank 20 is preferably a steel cylinder having an internal length of about 5.5 inches, an internal diameter of about 1.5 inches, and being capable of safely withstanding internal pressures of at least 300 p.s.i. The end of tank 20 opposite nozzle 24 is coupled to carburetor 16 via "T" fitting 26 and another steel fuel line 28 (also capable of withstanding internal pressures of at least 300 p.s.i.) through which vapourized fuel is delivered from vapour tank 20 to carburetor 16.

The third port of "T" fitting 26 is coupled to fuel return line 30 which in turn mates with the inlet port of housing 32. Housing 32 contains a normally closed pressure relief valve (not visible in FIG. 2, but represented at 22 in FIG. 1). The discharge port of housing 32 is coupled to fuel tank 12 via return line 34. Reduction fittings 36, 38 compensate for the difference in the diameters of the threaded fittings of line 34 and housing 32. If the pressure in vapour tank 20 rises above 12 p.s.i. the normally closed biasing of valve 22 is overcome and the valve opens, thereby allowing excess fuel to escape from vapour tank 20 through "T" fitting 26 and lines 30, 34 for return to fuel tank 12. This prevents flooding of carburetor 16 and ensures that carburetor 16 is not damaged by subjecting it to the high pressures required to vapourize the fuel.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. In an internal combustion engine fuel system having a fuel tank from which fuel is supplied to a carburetor for controlled delivery to the engine, the improvement comprising:

(a) a vapour tank for containing pressurized, vapourized fuel;

(b) a nozzle for vapourizing said fuel and for spraying said vapourized fuel under high pressure into said vapour tank;

(c) a high pressure pump for pumping fuel from said fuel tank and for forcing said fuel through said nozzle under high pressure; and, (d) a fuel delivery line for delivering pressurized, vapourized fuel from said vapour tank to said carburetor.

2. An improved fuel system as defined in claim 1, further comprising a normally closed pressure relief valve coupled between said vapour tank and said carburetor for returning excess fuel from said vapour tank to said fuel tank when the vapour pressure in said vapour tank exceeds a preselected pressure.

3. An improved fuel system as defined in claim 2, wherein said high pressure pump forces said fuel through said nozzle at a pressure of about 100 to 125 p.s.i.

4. An improved fuel system as defined in claim 3, wherein said nozzle sprays about 3 gallons of fuel per hour into said vapour tank.

5. An improved fuel system as defined in claim 2, wherein said pressure relief valve opens when said preselected pressure is about 12 p.s.i.

6. A fuel pressurization and vapourization system for an internal combustion engine having a fuel tank from which fuel is supplied to a carburetor for controlled delivery to the engine, said system comprising:

(a) a vapour tank for containing pressurized, vapourized fuel;

(b) a nozzle for vapourizing said fuel and for spraying said vapourized fuel under high pressure into said vapour tank;

(c) a high pressure pump for pumping fuel from said fuel tank and for forcing said fuel through said nozzle under high pressure; and, (d) a fuel delivery line for delivering pressurized, vapourized fuel from said vapour tank to said carburetor.

7. A fuel vapourization system as defined in claim 6, further comprising a normally closed pressure relief valve coupled between said vapour tank and said carburetor for returning excess fuel from said vapour tank to said fuel tank when the vapour pressure in said vapour tank exceeds a preselected pressure.

8. An improved fuel system as defined in claim 7, wherein said high pressure pump forces said fuel through said nozzle at a pressure of about 100 p.s.i. to 125 p.s.i.

9. An improved fuel system as defined in claim 8, wherein said nozzle sprays about 3 gallons of fuel per hour into said vapour tank.

10. An improved fuel system as defined in claim 9, wherein said pressure relief valve opens when said preselected pressure is about 12 p.s.i.

11. A method of improving the fuel economy of an internal combustion engine having a fuel system in which fuel is supplied from a fuel tank to a carburetor for controlled delivery to the engine; said method comprising, prior to supply of said fuel to said carburetor, the steps of:

(a) vapourizing said fuel by forced passage thereof through a nozzle; and, (b) pressurizing said fuel.

12. A method as defined in claim 11, wherein said fuel is pressurized to about 12 p.s.i.

* * * * *